United States Patent [19]

Hommel et al.

[11] Patent Number: 4,925,600

[45] Date of Patent: May 15, 1990

[54] PROCESS FOR THE PRODUCTION OF PARTICULATE AMMONIUM NITRATE FOR SOLID FUELS OR EXPLOSIVES

[75] Inventors: Horst Hommel, Karlsruhe; Hiltmar Schubert, Walzbachtal, both of Fed. Rep. of Germany

[73] Assignee: Fraunhofer-Gesellschaft zur Forderung der angewandten Forschung e.V., Munich, Fed. Rep. of Germany

[21] Appl. No.: 132,255

[22] Filed: Dec. 14, 1987

[30] Foreign Application Priority Data

Dec. 16, 1986 [DE] Fed. Rep. of Germany ..... 3642850

[51] Int. Cl.[5] ..... D03D 43/00; C06B 21/00

[52] U.S. Cl. ..... 264/3.4; 264/3.1; 149/109.6

[58] Field of Search ..... 264/3.1, 3.4, 3.5, 3.6; 149/109.6, 46, 60

[56] References Cited

U.S. PATENT DOCUMENTS

| | | | |
|---|---|---|---|
| 3,870,578 | 3/1975 | Nichols, Jr. | 149/19.4 |
| 4,033,264 | 7/1977 | Bolza et al. | 149/43 X |
| 4,077,820 | 3/1978 | Bolza et al. | 149/109.4 |
| 4,102,953 | 7/1978 | Johnson et al. | 264/3.2 |
| 4,112,849 | 9/1978 | Jones | 264/3.1 X |
| 4,131,051 | 12/1978 | Schaffling | 264/3.1 X |
| 4,179,327 | 12/1979 | Seldner | 149/3 X |
| 4,187,194 | 2/1980 | Wellman et al. | 264/4 X |

*Primary Examiner*—Peter A. Nelson

*Attorney, Agent, or Firm*—Antonelli, Terry & Wands

[57] ABSTRACT

Particulate ammonium nitrate for use as an oxidizer in solid propellants or explosives is, according to a first alternative, produced in that a solid mixture of ammonium nitrate with phase stabilizers, e.g. metal oxides is melted in several small batches housed in spatially separate manner and reactively reacted, the melts of the individual batches are successively atomized by drawing off and the mixture is supplied cyclically to all the batches, the melt particles being solidified in a cooling gas sinking stream. According to another alternative, initially a phase-stabilizing additive in the form of a metalamine complex is reacted in the aqueous phase from metal nitrate and ammonia, dried and mixed with solid ammonium nitrate, the mixture is melted and then atomized by drawing off. In addition, both processes can be combined.

5 Claims, 1 Drawing Sheet

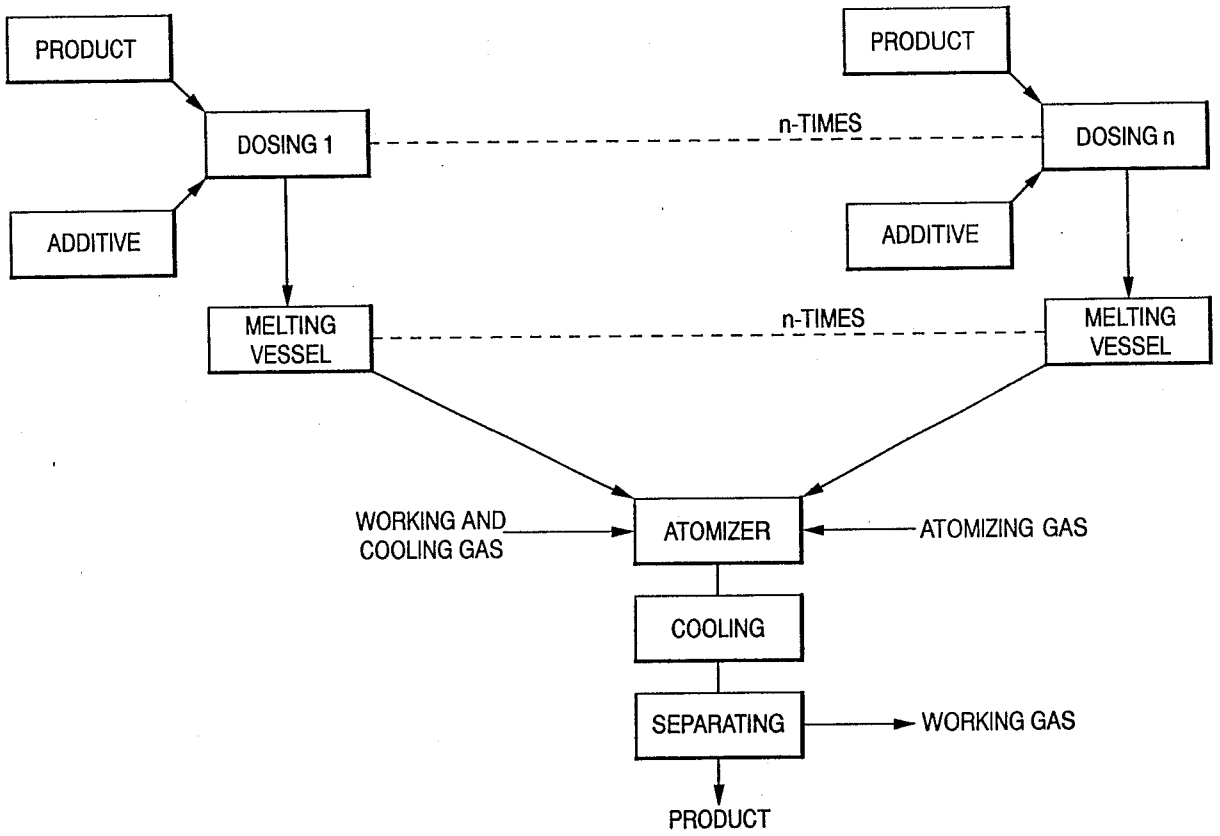
PRODUCT
ADDITIVE
DOSING 1
n-TIMES
PRODUCT
ADDITIVE
DOSING n
n-TIMES
MELTING VESSEL
MELTING VESSEL
WORKING AND COOLING GAS
ATOMIZER
ATOMIZING GAS
COOLING
SEPARATING
WORKING GAS
PRODUCT

PROCESS FOR THE PRODUCTION OF PARTICULATE AMMONIUM NITRATE FOR SOLID FUELS OR EXPLOSIVES

The present invention relates to a process for the production of particulate ammonium nitrate for use as an oxidizer in solid fuels or explosives, in that a solid mixture of ammonium nitrate and additives for phase stabilization purposes, e.g. copper and/or nickel oxide is melted and reacted, the melt is atomized by drawing off and the melt particles are solidified in a cooling gas sinking stream.

The aforementioned process and an apparatus for the performance thereof are known DE-OS 33 18 652). In this process, the atomized melt particles drawn off from a melting vessel are brought into a slow sinking or settling movement in that the cooling gas is supplied in two partial streams, whereof one acts directly below the atomizing nozzle and in tangential manner on the out&-flowing melt particle jet, whilst a further cooling gas front is supplied axially parallel to the atomizing axis. This makes it possible to obtain spherical particles with a wide particle size distribution for obtaining a high bulk density and at the same time a high individual particle density. This process would also be suitable for the production of spherical ammonium nitrate particles for use as an oxidizer in solid fuels, propellant powders and explosives. For this use, it is necessary to add to the ammonium nitrate phase stabilizers or burn off catalysts constituted by metal oxides and in particular copper or nickel oxide. The melting of these two solids and the reactive reaction of the metal oxides require a long heat-up time, which leads to a risk of self-decomposition of the overheated melt. There is also a considerable explosion risk, which makes it necessary to keep the melt quantity and therefore the dimensioning of the melt particles as small as possible, so that damage is kept to a minimum if an unavoidable accident occurs. Thus the product conversion or reaction is correspondingly low, which makes the process unsuitable for industrial purposes. In addition, a continuous addition of the starting components is not possible, because the heavier metal oxides sink in the melt and would lead to problems during atomization. A reproducible reaction of pure ammonium nitrate and phase stabilizers is also not ensured. The reactive reaction (complexing) takes place incompletely or requires reaction times of several hours. There is also an increased thermal decomposition of the ammonium nitrate. Thus, the process can only be performed batchwise with the disadvantage of long starting-up phases for melting and reacting the solids.

The problem of the present invention is to so further develop the aforementioned process that there is an adequately high output for the industrial production of ammonium nitrate, whilst at the same time reducing accident risks to a minimum and avoiding or minimizing the thermal decomposition of ammonium nitrate.

According to a first solution concept of the invention, this problem is solved in that the melt is successively produced in several small batches housed in spatially separate manner, the melt of each batch is supplied to a common spraying vessel and the mixture is cyclically supplied to all the batches.

Due to the fact that according to the invention there is a large number of small melt batches, the accident risk is restricted to such a small individual batch. Through the further measure of the spatially separated housing of the batches, it is ensured that any accident does not extend to other batches. It is still possible to achieve a quasicontinuous process with a correspondingly high product reaction or conversion and which is based on the sum of the individual batches. The continuity of the process is further optimized in that the solid starting mixture is cyclically supplied to the batches.

It is also possible with the inventive process to take account of different reaction times for different reactants and/or particle sizes of the reactants through a corresponding control of the individual batches. Finally, the individual melting vessels can be housed in robust building parts, so that plant damage by an explosion to an individual batch can be kept within narrow boundaries.

Another solution concept of the invention is based on the aforementioned process, but in which use is made of a metal (Ni or Cu) nitrate in place of a metal oxide. This process has been inventively further developed in such a way that in a preliminary stage a metal (Ni, Cu) ammine complex is separately produced and dried in an aqueous phase, is mixed with the solid ammonium nitrate and the nickel nitrate and/or copper nitrate, the mixture is melted and finally the melt is atomized.

Thus, in this process the metal complex formation is transferred into a preliminary stage in the aqueous phase and said reaction can be carried out without any problem. The dried ammine-metal complex obtained is then mixed with the solid ammonium nitrate and the metal nitrates. On melting, a cutectic of ammonium nitrate and metal complex is formed, which only requires a very short effective melting time. Thus, there is no need for the relatively long reaction times in the melting process required in the first-mentioned process and in particular any risk of overheating the melt is avoided. Due to the limited heat-up time, even in the case of batchwise processing, compared with the known process there is a much higher throughput with an up to ten times higher daily output.

According to an embodiment of the aforementioned process the nickel and/or copper content or the metal-/ammine complex content of the end product is so adjusted by the mixing ratio of ammonium nitrate, metal nitrate and metal/ammine complex, that the final metal content is between 1 and 5%. In this process, both components are present in dry, solid form. This makes it possible to dose the mixture to the melt in proportion to the quantity drawn off for atomization. Since, unlike in the process according to the first solution concept of the invention, the specific gravities of the metal complex and the pure ammonium nitrate do not differ very greatly, in the case of continuous dosing in there is no risk of the mixture separating in the melt as a result of different sinking or settling rates. Moreover, the mixture can be stirred throughout the melting-spraying process, in order to ensure a homogeneous mixture.

It is finally inventively possible in the previously described process to produce the mixture of metal complex, nickel and/or copper nitrate and pure ammonium nitrate in several small batches housed in spatially separated manner and to atomize the melt of each batch individually or in a continuous sequence.

Thus, there is a maximum product reaction or turnover, with a maximum safety factor in a single very small melting/atomizing vessel.

BRIEF DESCRIPTION OF THE DRAWING

The process is diagrammatically shown in the attached drawing flow chart.

There are 1 to n dosing devices, to which are in case supplied the product, namely ammonium nitrate in solid form and the additives for phase stabilization, namely either copper and/or nickel oxide or a metal (Ni,Cu) ammine complex with nickel and/or copper nitrate. There are also 1 to n melting vessels, with each of which is associated one of the dosing devices. The melting vessels and dosing devices are housed in spatially separated manner. From the melting vessels the melts are supplied to a common atomizer, in which the melts are atomized and cooled in the cooling gas sinking flow, so that at the end of the sinking path particulate ammonium nitrate can be separated from the sinking flow. The atomizer can be constituted by a known means, as described by the inventors in their German patent 33 18 962.

Example 1: Production of the metal/ammonium nitrate complex 50 kg of $Ni(NO_3)_2$ are dissolved in 45 kg of water and reacted with 130 litres of aqueous 25% $NH_3$ solution, accompanied by simultaneous cooling with ice water. The precipitate formed (Ni-complex) is separated, washed and dried. For melting and atomizing purposes, crude ammonium nitrate, nickel nitrate and metal/ammonium nitrate complex are mixed in the desired ratio for setting a corresponding nickel content in the end product (e.g. 1 to 5% nickel content).

Example 2: Production of a phase-stabilized ammonium nitrate by mixing the components For producing a phase-stabilized ammonium nitrate with a 2.18% end content of nickel (corresponding to 3% $Ni_2O_3$) 4.65 parts of nickel-tetraammine complex are mixed with 5.39 parts of nickel-nitrate-hexahydrate and 91.96 parts of ammonium nitrate. The mixture has a melting point of 130 to 160° C.

We claim:

1. A process for producing particulate ammonium nitrate for use as an oxidizer in solid propellants or explosives, wherein a solid mixture of ammonium nitrate and at least one additive for effecting phase stabilization is melted and reacted, said additive being selected from the group consisting of copper oxide, nickel oxide and mixtures thereof; the melt is atomized to form melt particles; and the melt particles are solidified in a cooling gas stream; said process being further characterized by successively producing the melt in several small batches, said batches being housed in a spatially separated arrangement; supplying the melt of each batch to a common spraying vessel; atomizing the melt; and cyclically supplying the mixture to each of the several batches.

2. A process for producing particulate ammonium nitrate for use as the oxidizer in solid propellants or explosives, which comprises forming a mixture of solid ammonium nitrate, at least one additive for phase stabilization a metal (Cu, Ni) -amine complex, melting the mixture to form a melt; atomizing the melt to produce melt particles; and solidifying the melt particles in a cooling gas stream; in a preliminary stage prior to melting the mixture, producing the metal (Ni, Cu)-ammine complex separately in an aqueous phase, drying the complex and mixing the dried complex with a solid ammonium nitrate and with an additive selected from the group consisting of nickel nitrate, copper nitrate or a mixture thereof.

3. A process according to claim 2, wherein the content of at least one of nickel and copper or the metal-/ammine complex content of the end product is so adjusted by the mixing ratio of ammonium nitrate, metal nitrate and metal/ammine complex that the final content is between 1 and 5%.

4. A process according to claim 2, wherein the mixture of metal complex, nickel nitrate and pure ammonium nitrate is continuously dosed into the metal in proportion to the quantity drawn off for atomization.

5. A process according to one of claims 2 to 4, further comprising producing the mixture of metal complex, nickel nitrate and ammonium nitrate in several small batches, said batches being housed in a spatially separate arrangement and atomizing the melt of each batch individually or in continuous sequence.

* * * * *